United States Patent [19]

Richards

[11] 4,051,826

[45] Oct. 4, 1977

[54] MEANS AND METHOD OF INJECTING CHARGED FUEL INTO INTERNAL COMBUSTION ENGINES

[76] Inventor: Clyde N. Richards, 4887 Mission Blvd., San Diego, Calif. 92109

[21] Appl. No.: 594,748

[22] Filed: July 10, 1975

[51] Int. Cl.[2] ..... F02D 23/00

[52] U.S. Cl. ..... 123/143 B; 123/32 SJ; 123/119 E; 315/111

[58] Field of Search ..... 239/590.5, 567, 15; 123/32 V, 32 SJ, 143 B, 144, 169 R, DIG. 9, 119 E, 325 A, 122 F; 315/111

[56] References Cited

U.S. PATENT DOCUMENTS

| | | | |
|---|---|---|---|
| 1,310,970 | 7/1919 | Stroud | 123/32 V |
| 2,331,912 | 10/1943 | Holthouse, Jr. | 123/32 SJ |
| 2,391,220 | 12/1945 | Beeh | 123/32 SJ |
| 2,495,346 | 1/1950 | Ramsdell | 239/567 |
| 3,173,409 | 3/1965 | Warren | 123/32 SJ |
| 3,434,461 | 3/1969 | Beesch | 123/32 SJ |

FOREIGN PATENT DOCUMENTS

| | | | |
|---|---|---|---|
| 14,662 | 6/1912 | United Kingdom | 123/32 V |

*Primary Examiner*—Carroll B. Dority, Jr.
*Assistant Examiner*—David D. Reynolds
*Attorney, Agent, or Firm*—Verbeck and Haller

[57] ABSTRACT

The invention is a means and method of injecting fuel into the cylinders of an internal combustion engine wherein the fuel is introduced under pressure to each cylinder through a metallic fuel tube having an integral and preferably multiplyorificed nozzle thereon, the tube and nozzle being charged to a high electrical potential, causing injected fuel to assume a charge and be repelled from the nozzle in small droplets which in turn disperse into smaller droplets due to internal repulsion created by the charge, the result being the rapid and thorough atomization of fuel so that quick and more complete combustion will occur. The applied charge may be reversed at the end of the injection cycle to cause current flow between the droplets and the oppositely charged nozzles to ignite, or further speed combustion of, the mixture.

4 Claims, 10 Drawing Figures

MEANS AND METHOD OF INJECTING CHARGED FUEL INTO INTERNAL COMBUSTION ENGINES

BACKGROUND OF THE INVENTION

During the combustion phase of the operation of an internal combustion engine, fuel droplets in the cylinders, whether introduced by injection or as a mixture through a carburetion system, are incompletely burned due to incomplete evaporation and ignition delay resulting in the engine operating at less than maximum efficiency and the production of pollutants in the form of unburned, or partially burned, hydrocarbons. Efforts have been made to reduce the size of the fuel droplets by the creation of a corona discharge within the cylinders, and by charging the fuel/air mixture in the carburetion or intake systems, including the variation of charging the fuel oppositely to the air to induce closer association of the air with fuel droplets. However, these methods have not met with notable success and are not currently in common use.

SUMMARY OF THE INVENTION

The present invention is a means and method of successfully forming fuel droplets which by the use of a charge imparted to injected fuel are smaller, and thus more quickly evaporated and thoroughly burned than droplets produced in a conventional injected or carbureted engine. An injector is used which includes an insulated metallic fuel tube terminating in an injection nozzle within the cylinder, the tube and nozzle being charged with a high potential at least during the fuel injection stage of engine operation.

The nozzle preferably has a plurality of fuel passageways which inject fuel as several separate, generally oppositely directed streams, and as the fuel passes through and exits the nozzle it is imparted with a charge which, being the same as the nozzle charge, causes the injected droplets to be repelled from the nozzle and internally repelled to form an extremely fine mixture which ideally approaches a state of nearly complete evaportion. Simultaneously with the dispersion of the mixture combustion occurs and is enhanced by fuel ionization caused by corona discharge, as well as reverse current flow to the nozzle from the droplets should the potential on the nozzle be suddenly reversed upon completion of injection.

It is also possible to construct the injectors with a suitable rigid insulating material around the fuel tube and a threaded sleeve around the insulation so that the injectors may be mounted in the spark plug holes of conventional gasoline engines with some modification.

DETAILED DESCRIPTION OF THE PREFERRED EMBODIMENT

Figure 1:
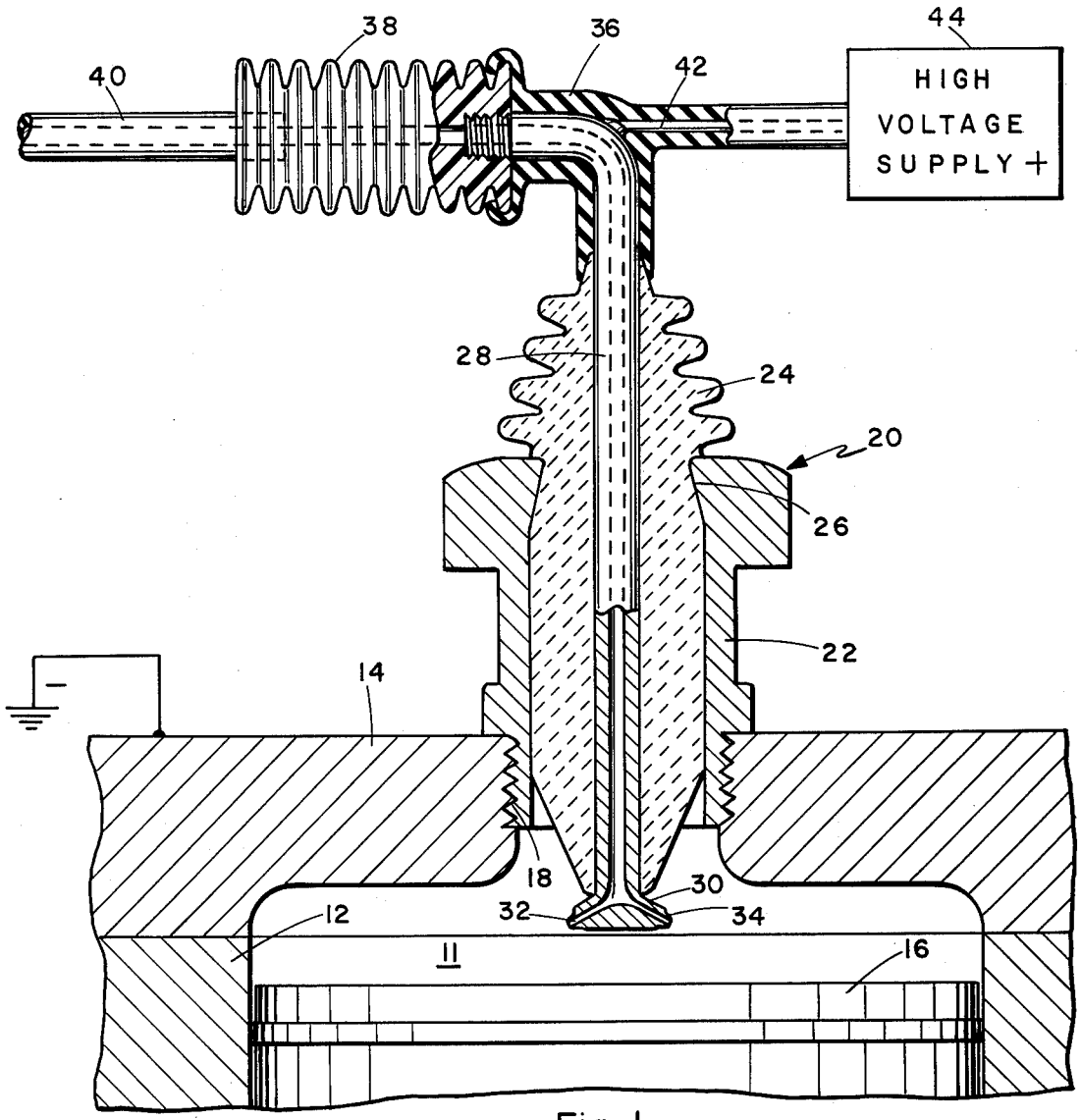
FIG. 1 is a side elevation view, with portions in section of a fuel injector installed in a cylinder head.
Figure 2:
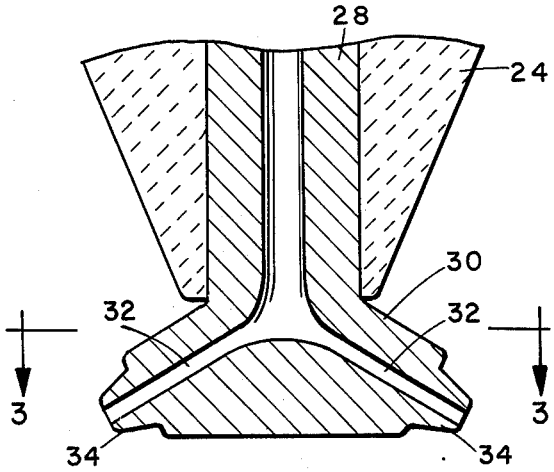
FIG. 2 is an enlarged axial sectional view of the injector tip.
Figure 3:
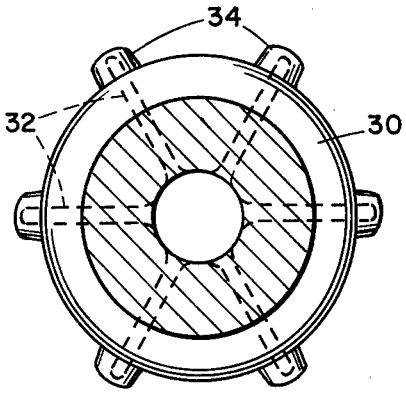
FIG. 3 is a sectional view taken on line 3—3 of FIG. 2.

A diagrammatic illustration of a portion of an internal combustion engine is shown in FIG. 1, wherein the upper portion of a cylinder is illustrated at 11 having walls 12, a head 14, and housing a piston 16 in conventional fashion. The air intake and exhaust systems do not form part of the invention and are not illustrated, and the cylinder shown in the drawings would ordinarily be one of several in the complete engine which would be identically constructed in regard to the invention and are thus not shown to avoid repetition.

In the cylinder head 14 is a threaded bore 18 in which is seated an injector generally indicated at 20 which is constructed in its preferred form of an outer sleeve 22 which is threaded to engage the bore, and houses an elongated rigid insulation element 24 which conforms to the interior surface of the sleeve and is secured against outward thrusts resulting from pressure in the cylinder by an inwardly directed upper wall 26.

Passing through the center of the insulation 24 is a fuel tube 28 which is metallic and terminates in an integral nozzle 30 which in the preferred form illustrated includes a plurality of fuel passageways 32, six as shown, which exit the nozzle through generally rounded protuberances 34 in substantially opposite directions. These protuberances serve the important function of intensifying the electrical field locally around the fuel injection points due to the well known principals that field strength increases inversely with the radious of curvature and charges reside primarily in the outer extremities of a charged body.

The upper end of the tube 28 is shielded by a flexible insulating sheath 36 and enters an insulated junction sleeve 38 which connects to a fuel line 40 leading from an appropriately timed injection pump, not shown.

Figure 8:
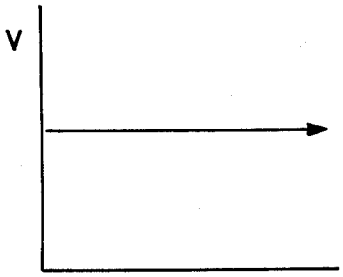
FIG. 8 illustrates a direct current wave form supplied by the voltage source.
Figure 9:
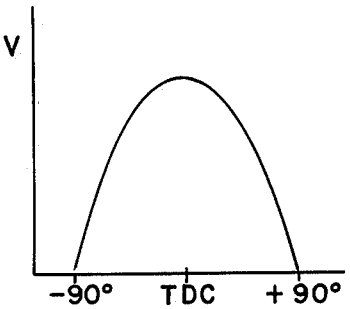
FIG. 9 illustrates a modified wave form supplied by the volate source comprising a half-wave of alternating current.

Connected to the projecting end of the fuel tube is an insulated wire 42 which connects voltage supply 44 to the fuel tube and thus to the nozzle 30. The particular wave form produced by the voltage is subject to variance, three typical wave forms being shown in FIGS. 8–10. FIG. 8 displays a straight line direct current voltage which is maintained constant at the injector nozzle, whereas FIG. 9 illustrates a voltage representing approximately a positive half-cycle of a sine wave, beginning at zero at the −90° position in the cycle of a single piston stroke, peaking at top dead center, and falling off to zero againt at 90°. Since two piston cycles occur for every engine cycle of a four stroke engine, four cylinders could be supplied with a voltage from a distributor having approximately the form of the FIG. 9 wave form. The limits of 90° and −90° represent the outside limits of the wave form and very likely a half wave bounded at plus and minus 45° or less would prove adequate and more practical for engines having more than four cylinders.

Figure 10:
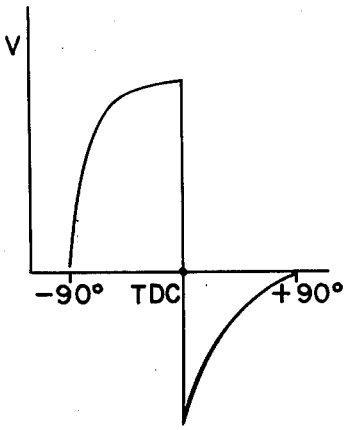
FIG. 10 illustrates a modifed wave form resulting from sudden polarity reversal to cause fuel ignition.

FIG. 10 represents a wave form which is reversed at top dead center (TDC in the graph), which may be used to speed ignition of the fuel mixture as discussed infra.

Figure 4:
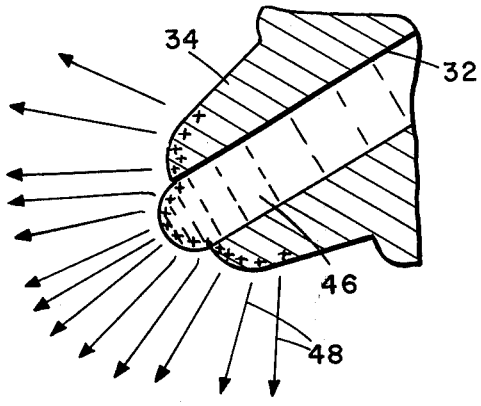
FIGS. 4–7 illustrate the development of a charged particle spray from one nozzle of the injector tip.
Figure 5:
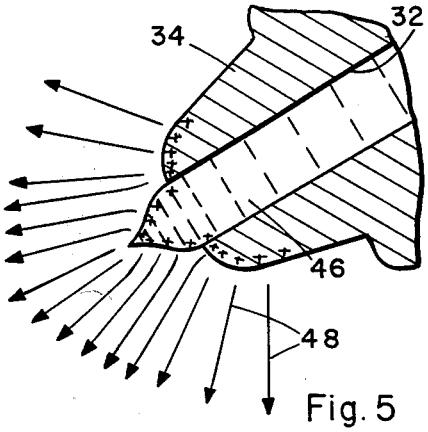

The operation of the injector will now be described with reference to the diagrammatic illustrations of one of the nozzle protuberances 34 at the various stages of injection of a fuel mass 46 shown in FIGS. 4–7. FIG. 4 shows the fuel mass as it appears immediately after the initiation of the injection cycle, having a curved projected surface. The lines of electrical force are shown at 48. At this stage, the fuel, which may have already picked up some charge from the fuel tube, begins rapidly accumulating charge as it extends from the tip of the nozzle protuberance 34, causing repulsion of the fuel from the nozzle and resulting the "stretching" of the fuel into the somewhat pointed configuration of FIG. 5.

Figure 6:
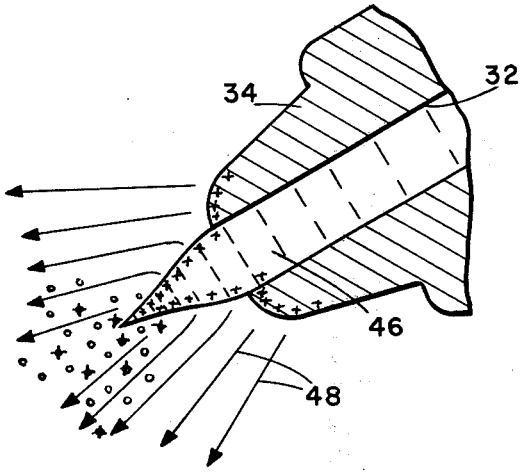
Figure 7:
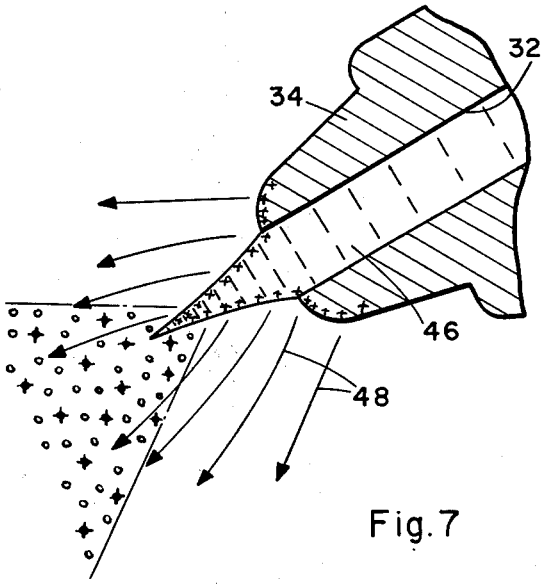

As more charge is conducted to the fuel mass, it becomes more pointed as it repels from the nozzle, resulting in the escape of fuel droplets from the fuel mass and continued repulsion of these individual droplets as shown in FIGS. 6 and 7. Each of these droplets, being charged, will tend to fragment and further disperse as a result of internal repulsive forces into smaller and smaller droplets. The smaller the droplets become, the faster they evaporate due to the increase in the ratio of surface area to volume, so that with the aid of the surface electrical stresses, almost complete evaporation occurs.

The result of the finer droplet structure of course is more complete combustion of fuel and therefore less emission of pollutants and more power. The injector may be used in diesel or gasoline engines and combustion in the latter can be accomplished either conventionally by a spark plug, or by reversing the polarity of the nozzle suddenly as shown in FIG. 10 so that no spark plug is needed. This sudden reversal is effected upon the piston reaching top dead center and immediately subsequent to the termination of the fuel injection phase, and assuming the charge on the droplets to be positive as shown in the drawings will cause a sudden electron current flow from the injector to the fuel mist, creating a spark-type ignition.

Several other phenomena take place within the fuel mixture which advance the combustion speed in addition to the fine atomization, which approaches complete evaporation. The cascading of electrons caused by the presence of droplets having a high positive charge in the presence of air causes the dissolution of oxygen molecules and the ionization of the atoms thus produced, as well as the emission of ultra violet and visible light which results in the conversion of hydrocarbon fuel molecules to radicals, which is necessary prior to their oxidation.

In addition, by the very nature of the droplet dispersion and repulsion process, the greatest concentration of fuel at any point in time will be near the nozzle, permitting a "pre-burning" effect to occur similar to that of a stratified charge engine. This, in conjunction with the almost explosive evaporation of fuel droplets, results in an extremely clean-burning and efficient engine. Another advantage of the fuel charging technique is the ability of the engine to function properly with lower pressure injection and wider injection orifices than would be needed in a conventional fuel injected engine such as a diesel. High injection pressures are ordinarily needed to insure proper atomization of fuel, and as the pressure abates at the termination of the injection phase, relatively large droplets are introduced into the cylinder, a phenomena termed "dribbling." These high pressures, which are a major cause of injector breakdown, are not needed with the present invention since the atomization rate is much more independent of pressure and injection rate.

I claim:

1. A method for injecting fuel in an electrically charged condition into a cylinder of an internal combustion engine comprising:

a. injecting pressurized fuel through an electrically conductive fuel nozzle during a portion of the cycle of said engine;

b. charging said nozzle to one polarity during the introduction of fuel therethrough, and reversing the polarity of the charge on said nozzle substantially at the termination of the fuel injection phase.

2. A method according to claim 1 wherein said fuel nozzle is connected to a conductive charged fuel line, and step (a) includes the forcing of pressurized fuel through said fuel tube.

3. The method according to claim 1 wherein said fuel nozzle contains a plurality of divergent fuel passageways directed in substantially opposite directions.

4. The method according to claim 3 wherein said nozzle is provided with a plurality of generally radially directed protrusions, and each of said fuel passageways passes through and exits from a respective one of said protrusions, whereby an electrical field emanating from said nozzle is concentrated at said protrusion.

* * * * *